US006938450B1

(12) United States Patent
Zhang et al.

(10) Patent No.: US 6,938,450 B1
(45) Date of Patent: Sep. 6, 2005

(54) DOUBLE NUT TENSIONER ASSEMBLY FOR PRE-STRETCHED TIE RODS

(75) Inventors: Ouqi Zhang, Downingtown, PA (US); James P. Larkin, Hummelstown, PA (US)

(73) Assignee: Dana Corporation, Toledo, OH (US)

( * ) Notice: Subject to any disclaimer, the term of this patent is extended or adjusted under 35 U.S.C. 154(b) by 364 days.

(21) Appl. No.: 10/359,695

(22) Filed: Feb. 7, 2003

(51) Int. Cl.[7] ..... B21D 26/02; B30B 15/04; B30B 15/28

(52) U.S. Cl. ..... 72/60; 72/455; 100/214; 100/258 R

(58) Field of Search ..... 72/60, 61, 455; 100/214, 231, 258 R

(56) References Cited

U.S. PATENT DOCUMENTS 1,251,430 A * 12/1917 Sherman ..... 100/214
1,636,057 A * 7/1927 Jones ..... 72/248
1,974,148 A * 9/1934 Byerlein ..... 100/214
2,934,968 A * 5/1960 Neumann et al. ..... 74/89.23
4,240,342 A 12/1980 Delmer
4,346,578 A 8/1982 Harrison et al.
4,365,914 A 12/1982 Sluys
4,718,049 A 1/1988 Crowell et al.
5,950,471 A * 9/1999 Everlove, Jr. ..... 72/88
6,015,226 A 1/2000 Weller et al.
6,062,057 A * 5/2000 Minnerop ..... 72/225
6,250,216 B1 6/2001 Bornhorst
6,536,251 B2 * 3/2003 Marando et al. ..... 72/61

* cited by examiner

*Primary Examiner*—David Jones
(74) *Attorney, Agent, or Firm*—Berenato, White & Stavish

(57) ABSTRACT

The tensioner assembly is provided for clamping at least two objects and comprises a tie rod member, a thrust ring positioned on the tie rod member against one of the objects, a first retaining member for removably engaging a distal end of the tie rod member, and a second retaining member for removably engaging the distal end of the tie rod member between the thrust ring and said first nut member and spaced apart therefrom. Each of the first and second retaining members is provided with a set of jackbolts adapted to engage complementary holes therein and to extend from the holes to compressively bias the thrust ring. The total load experienced by the tensioner assembly is shared by two retaining members so that load carried by the first retaining member remains substantially constant during operation, while the second retaining member is subject to stress variation.

20 Claims, 4 Drawing Sheets

DOUBLE NUT TENSIONER ASSEMBLY FOR PRE-STRETCHED TIE RODS

BACKGROUND OF THE INVENTION

1. Field of the Invention

The present invention relates to multi-jackbolt threaded tensioner assemblies and, more particularly, to a double nut tensioner assembly for pre-loading threaded tie rod members.

2. Description of the Prior Art

Hydro-forming is a well known metal working process that uses pressurized fluid to deform a closed channel workpiece, such as a tubular member, outwardly into conformance with a die cavity having a desired shape. As illustrated in FIG. 1, the typical hydro-forming press apparatus includes a frame having lower and upper platens 102 and 104 respectively, for receiving a hydro-forming die (not shown) therebetween having lower and upper die sections that are supported thereon for relative movement between opened and closed positions. The die sections have cooperating recesses formed therein that together define a die cavity having a shape corresponding to a desired final shape for the workpiece. When moved to the opened position, the die sections are spaced apart from one another to allow a workpiece to be inserted within or removed from the die cavity. When moved to the closed position, the die sections are disposed adjacent to one another so as to enclose the workpiece within the die cavity. The workpiece is then filled with a fluid, typically a relatively incompressible liquid such as water. The pressure of the fluid within the workpiece is increased to such a magnitude that the workpiece is expanded outwardly into conformance with the die cavity. As a result, the workpiece is deformed or expanded into the desired final shape. Hydro-forming is an advantageous process for forming vehicle frame components and other structures because it can quickly deform a workpiece into a desired complex shape.

The upper platen 104 and the lower platen 102 are connected together by a set of vertically extending compression tubes 106 (only one is illustrated in FIG. 1). The compression tubes 106 are generally hollow and cylindrical in shape. A tie rod 112 extends through each of the compression tubes 106 from the lower platen 102 to the upper platen 104. Each of the tie rods 112 is a generally solid cylindrical member having an upper end portion 114 that extends above the upper platen 104 and a lower end portion 116 that extends below the lower platen 102.

To maintain the die sections together during the hydro-forming process, a mechanical clamping device is usually provided. The mechanical clamping device mechanically engages the die sections to prevent them from moving apart from one another during the hydro-forming process. Usually the mechanical clamping device includes two or more tensioner assemblies 110 illustrated in detail in FIG. 2.

In the illustrated embodiment, each of the tensioner assemblies 110 includes the tie rod 112 having threaded end portions 114 and 116, a thrust member 118 concentrically positioned about the tie rod 112 and placed on the upper platen 104 and a nut member in the form of a nut member 120 or similar retaining devices, threaded onto the threaded end portions 114 and 116 of the tie rods 112. The nut member 120 is further provided with a plurality of threaded holes at circumferentially spaced apart locations extending substantially parallel to and spaced from the tie rod 112. As further illustrated in FIG. 2, the tensioner assembly 110 is further provided with a set of jackbolts 123 adapted to threadably engage the holes in the nut member 120. The jackbolts 123 are provided to extend from the holes in the nut member 120 to exert pressure against the thrust ring 118 through torquing the jackbolts 123 for applying compressive reaction forces on the thrust ring 18 in order to pre-stress the rod member 112 and the compression tube 106.

In operation of the hydro-forming press apparatus, the tie rod 112 is subject to a tension stress variation due to a pre-load thereof and a pressure fluctuation within the die cavity of the hydro-forming press apparatus. As a result, the rods of the hydro-forming press apparatuses may crack prematurely due to the stress fluctuation in the tie rods.

Minimum and maximum stresses at the threads engaged with the tensioner assembly 110 determine a fatigue strength of the tie rod 112. More specifically, the effective parameters are the alternating stress range that is the difference of the maximum and minimum stresses and the mean stress that is the average of the maximum and minimum stresses. The smaller the alternating stress range and/or the mean stress, the higher the fatigue strength.

Accordingly, it is the intent of this invention to overcome these shortcomings of the prior art, such as low fatigue strength of the tie-rods subject to tension stress variation.

SUMMARY OF THE INVENTION

The present invention provides an novel tensioner assembly for increasing the fatigue strength of tie rod members.

The tensioner assembly is provided for detachably clamping at least two objects, such as upper and lower platens of a hydro-forming press apparatus. The tensioner assembly in accordance with the preferred embodiment of the present invention comprises an elongated tie rod member extending through these two objects to be clamped, a thrust member concentrically positioned on the tie rod member against one of the objects, a first nut member for removably engaging a distal end of the tie rod member, and a second nut member for removably engaging the distal end of the tie rod member between the thrust ring and the first nut member and axially spaced from both the first nut member and the thrust ring. The first nut member has a plurality of threaded holes at spaced apart locations in the first nut member and extending substantially parallel to the tie rod member. Similarly, the second nut member has a plurality of threaded holes at spaced apart locations in the second nut member and extending substantially parallel to the tie rod member. The tensioner assembly further includes a first set of jackbolts adapted to threadably engage the holes in the first nut member and to extend from the holes to compressively bias the thrust member against one of the objects, and a second set of jackbolts adapted to threadably engage the holes in the second nut member and to extend from the holes to compressively bias the thrust member against the same object.

During installation, the second nut member is mounted first to the distal end of the tie rod spaced from the thrust member. Then, torque is applied to the jackbolts of the second nut member that develop a high thrust force against the thrust member to create a predetermined pre-load in the tie rod member by pre-stretching the rod member. Next, the first nut member is mounted to the distal end of the tie rod spaced from the second nut member. Subsequently, torque is applied to the jackbolts of the first nut member that develops a pre-load applied to the tie rod member from the first nut member composing a portion of the predetermined pre-load which releases the equal amount of the load from the second nut member.

In operation, the tie rod member is subject to a tension stress variation due to the pre-load and a pressure fluctuation between the compressed objects, such as the upper and lower platens of the hydro-forming press apparatus. Minimum and maximum loads within the tensioner assembly determine a fatigue life of the tie rod. In accordance with the present invention, the load carried by the first nut member remains substantially constant during operation, while the second nut member is subject to load variation. The total load of the tie rod now is shared by the two nut members, and a mean load and the load variation experienced by the second nut member are substantially reduced.

Therefore, the tensioner assembly in accordance with the present invention is a novel arrangement of the tensioner assembly for detachably clamping at least two objects, having two nut member sharing the total load of the tie rod member. As a consequence, the alternating stress range and a mean stress are smaller, and the fatigue strength of the tie rod member is improved.

BRIEF DESCRIPTION OF THE DRAWINGS

Other objects and advantages of the invention will become apparent from a study of the following specification when viewed in light of the accompanying drawings, wherein.

DETAILED DESCRIPTION OF PREFERRED EMBODIMENTS

Figure 2:
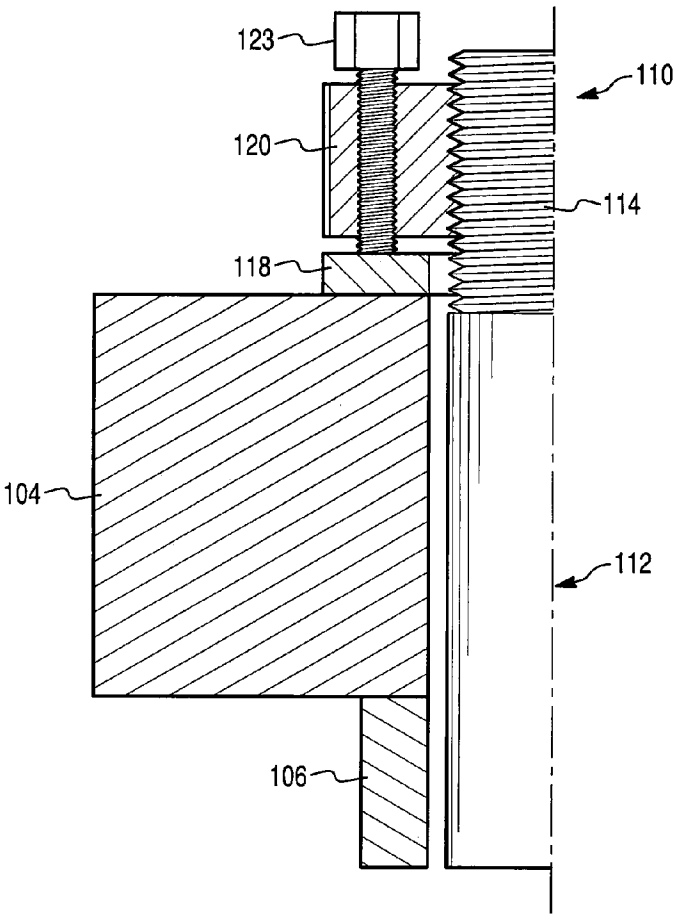
FIG. 2 is an enlarged partial sectional view of a typical tensioner assembly of the prior art employed in the conventional hydro-forming press apparatus, shown in a rectangle 'A' in FIG. 1.
Figure 1:
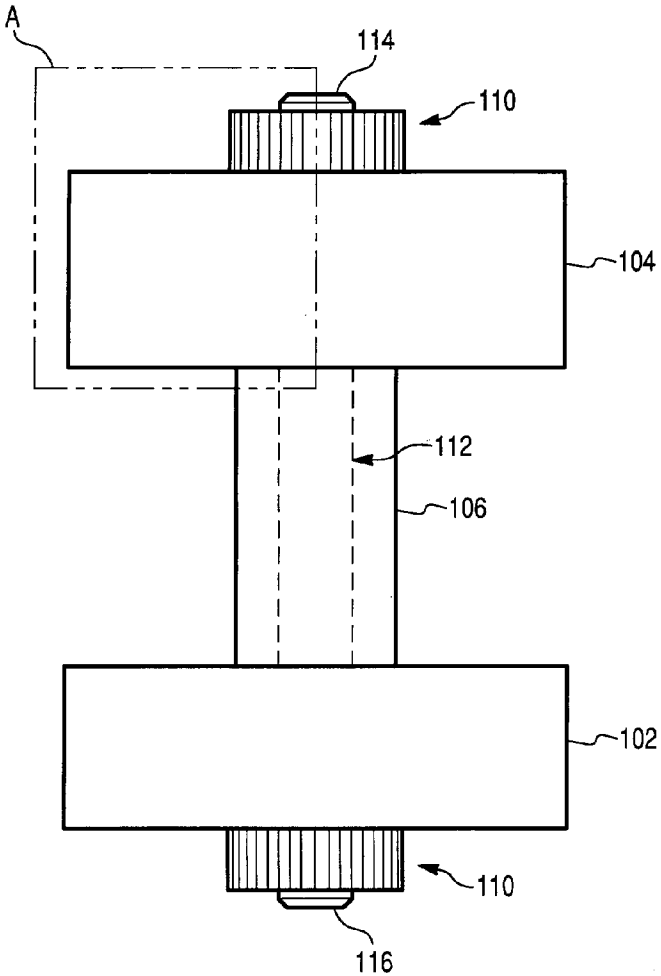
FIG. 1 is a partial elevational view of a conventional hydro-forming press apparatus of the prior art.

The preferred embodiment of the present invention will now be described with the reference to accompanying drawings.

In the present description of the preferred embodiment, certain terminology will be used for descriptive purposes only and is not intended to be limiting. The terms, such as "upper" and "lower" designate directions in the drawings to which reference is made, and are used for ease of explanation and are not limiting. Said definitions apply to the terms specifically mentioned above, derivatives thereof and words of similar import.

There are a variety of tie rod compression press assemblies in use today. For example, a type frequently employed in industry is a hydro-forming press apparatus, such as employed to form parts of a vehicular frame.

Figure 3:
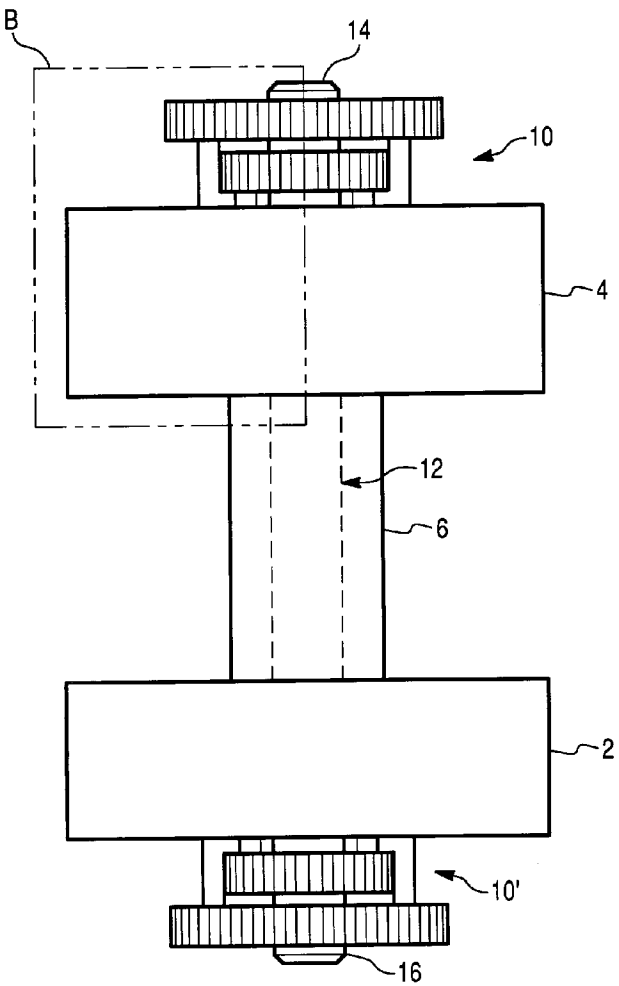
FIG. 3 is a partial view of a hydro-forming press apparatus employing a tensioner assembly in accordance with the present invention.

The hydro-forming press apparatus depicted in FIG. 3 basically includes a lower platen, indicated generally at 2, an upper platen, indicated generally at 4, and at least one compression tube 6 extending therebetween. As illustrated, the lower and upper platens 2 and 4 are generally box-shaped in construction. It will be appreciated by those skilled in the art that the hydro-forming press apparatus typically includes two or more compression tubes, although only one is illustrated in the accompanying drawing FIG. 3.

The lower and upper platens 2 and 4 are joined together by a tie rod member 12 freely extending through the compression tube 6. Although only one tie rod member 12 is shown, it is to be understood that the number of tie rods employed is not important for purposes of the invention. The tie rod member 12 is generally a solid cylindrical rod member having an upper end portion 14 that extends above the upper platen 4 and a lower end portion 16 that extends below the lower platen 2.

To prevent what is known in the trade as "lift off", the tie rod member 12 is often pre-loaded. The "lift off" is caused by an elongation of the tie rod member 12 under increasing stress experienced in its press operation. The consequence of lift off is the separation of parts of the hydro-forming press apparatus during a pressure cycle which is particularly disastrous when die assemblies are employed.

The pre-loading of the tie rod member 12 is accomplished by employing a pair of opposite, substantially identical tensioner assemblies 10 and 10' of the present invention mounted at distal ends 14 and 16 of the tie rod member 12. Alternatively, the second tensioner assembly 10' may be of different design. When tightened, the tensioner assemblies 10 and 10' are drawn into engagement with is the upper platen 4 and the lower platen 2 respectively, as well as the compression tube 6. As a result, the compression tube 6 is pre-loaded with compressive forces, for a purpose that was explained above. Moreover, instead of the second tensioner 10', there may be used a non-movable supporting device secured to a lower distal end of the tie rod member 12, or, instead of the second tensioner assembly 10', the distal end 16 of the tie rod member 12 may be fixed relative to the lower platen 2 by any appropriate means known in the art.

Those skilled in the art will understand, however, that the tensioner assembly of the present invention can be used with many different types of the tie rod compression press assemblies.

Figure 4:
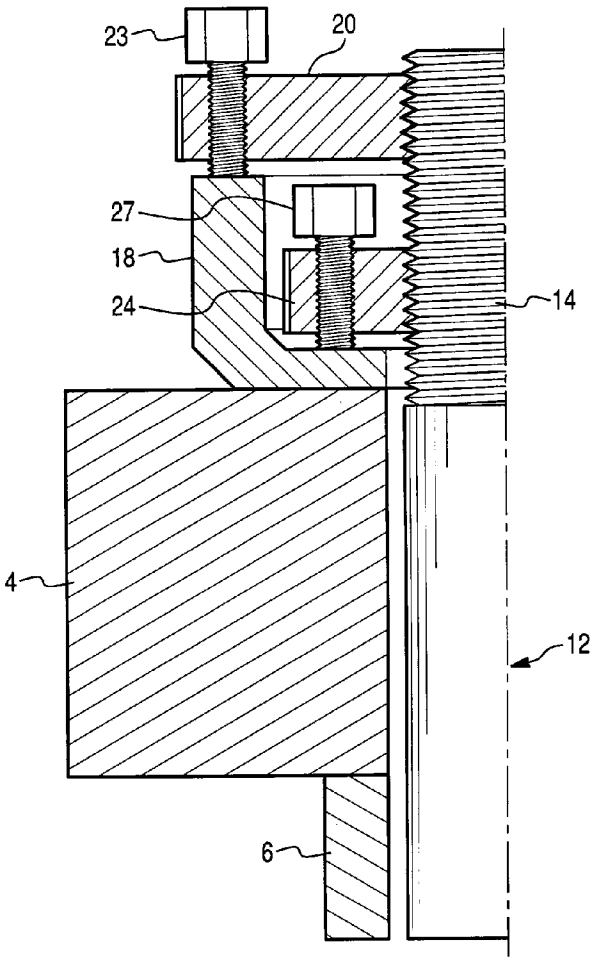
FIG. 4 is an enlarged partial sectional view of the tensioner assembly in accordance with the preferred embodiment of the present invention shown in a rectangle 'B' in FIG. 3.

FIG. 4 illustrates in details the tensioner assembly 10 in accordance with the preferred embodiment of the present invention. The tensioner assembly 10 comprises a thrust member 18 concentrically positioned about the tie rod member 12 and placed on the upper platen 4, a first nut member 20 removably engaging the distal end 14 of the tie rod member 12 and a second nut member 24 also removably engaging the distal end 14 of the tie rod member 12 between the thrust member 18 and the first nut member 20 and axially spaced from both the first nut member 20 and the thrust member 18.

Figure 5:
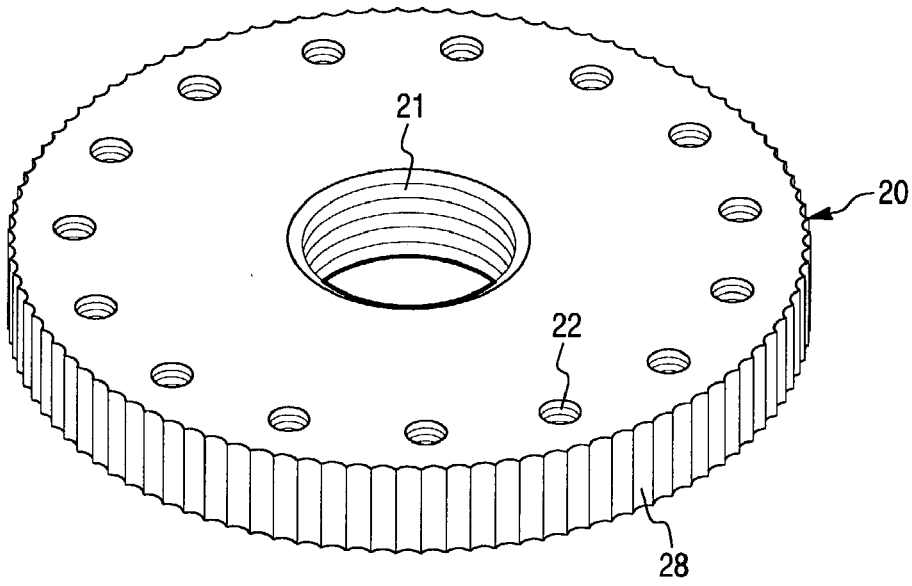
FIG. 5 is a top view of a first nut member in accordance with the preferred embodiment of the present invention.

Preferably, the distal end 14 of the tie rod member 12 is threaded and the first nut member 20 has a threaded central bore 21 provided with threads complementary to the threads on the distal end 14 of the tie rod member 12. Further preferably, as illustrated in FIG. 5, the first nut member 20 has a substantially cylindrical peripheral side surface 28. It will be appreciated by those skilled in the art that alternatively the peripheral side surface of the first nut member 20 may be of any appropriate shape, such as substantially hexagonal. The first nut member 20 is further provided with a plurality of threaded holes 22 at circumferentially spaced apart locations extending substantially parallel to and spaced from the central bore 21.

Figure 6:
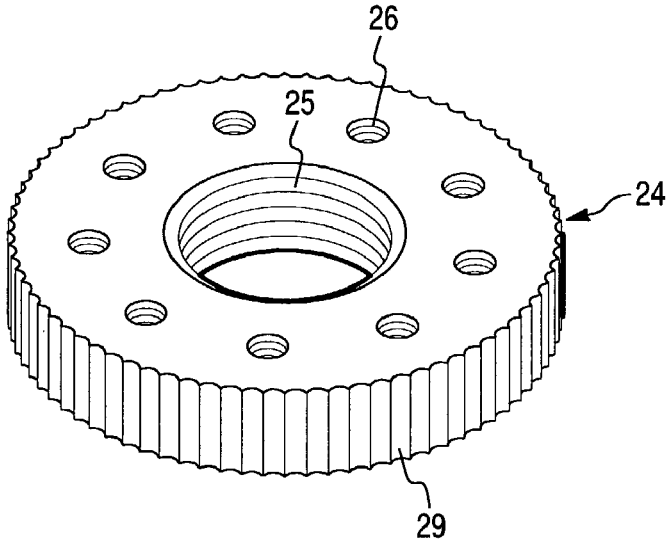
FIG. 6 is a top view of a second nut member in accordance with the preferred embodiment of the present invention.

Similarly, as illustrated in FIG. 6, the second nut member 24 preferably has having a threaded central bore 25 provided with threads complementary to the threads on the distal end 14 of the tie rod member 12, and a substantially cylindrical peripheral side surface 29. Again, it will be appreciated by those skilled in the art that alternatively the peripheral side surface of the second nut member 24 may be of any appropriate shape, such as hexagonal. The second nut member 24 is further provided with a plurality of threaded holes 26 at circumferentially spaced apart locations extending substantially parallel to and spaced from the central bore 25.

Figure 7:
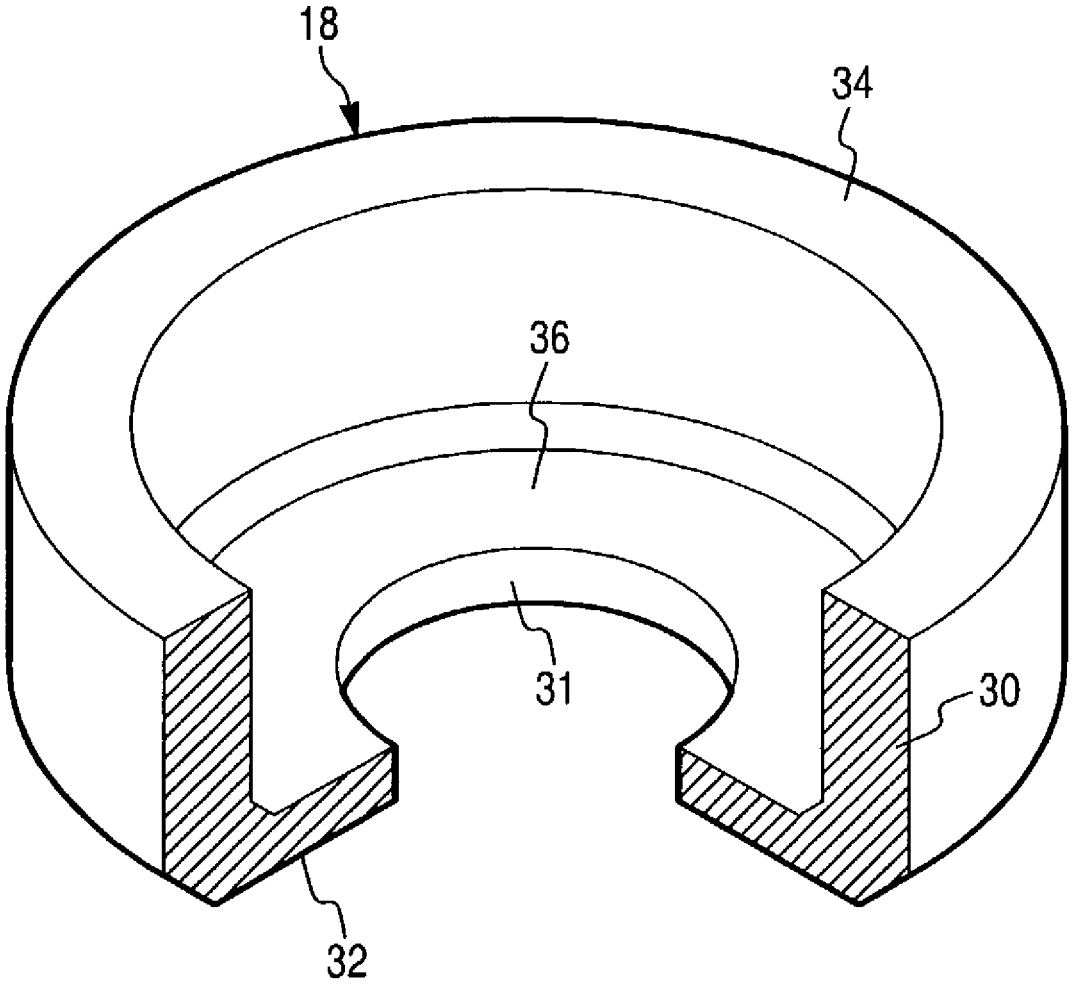
FIG. 7 is a partial perspective view of a thrust member in accordance with the preferred embodiment of the present invention.

As illustrated in details in FIG. 7, the thrust member 18 in accordance with the preferred embodiment of the present invention, has a cup-shaped body 30 provided with a central through hole 31 adapted to receive the tie rod member 12 therethrough. The thrust member 18 has a pressure contact surface 32 in contact with the upper platen 4, a first support surface 34 facing the first nut member 20, and a second support surface 36 facing the second nut member 24.

As further illustrated in FIG. 4, the tensioner assembly 10 is further provided with a first set of jackbolts 23 adapted to threadably engage the holes 22 in the first nut member 20 and a second set of jackbolts 27 adapted to threadably engage the holes 26 in the second nut member 24. The jackbolts 23 are provided to extend from the holes 22 to exert pressure against the thrust ring 18 through torquing the jackbolts 23 for applying compressive reaction forces on the first support surface 34 of the thrust ring 18 in order to pre-load the tie rod member 12. Similarly, jackbolts 27 are provided to extend from the holes 26 to exert pressure against the thrust ring 18 through torquing the jackbolts 23 for applying compressive reaction forces on the second support surface 36 of the thrust ring 18 in order to pre-load the tie rod member 12.

During the installation, the second nut member 24 is threaded first to the distal end 14 of the tie rod member 12 spaced from the thrust member 18. Then, torque is applied to the jackbolts 27 that develop a high thrust force against the thrust member 18. This trust force and an opposite reaction force on the second tensioner assembly 10' create a strong clamping force on the upper and lower platens 4 and 2, and build a predetermined pre-load $P_d$ applied to the tie rod member 12 from the second nut member 24. Next, the first nut member 20 is threaded to the distal end 14 of the tie rod member 12 spaced from the second nut member. Subsequently, torque is applied to the jackbolts 23 that develop the thrust force against the thrust member 18 so as to build the pre-load applied to the tie rod member 12 from the first nut member 20 composing a portion of the predetermined pre-load $P_d$, which releases the equal amount of the load from the second nut member 24. Once the jackbolts 23 of the first nut member 20 are tightened, the second nut member 24 will no longer experience this load. For example, if the first nut member 20 is tightened to 50% of the predetermined pre-load $P_d$, the load carried by the second nut member 24, after installation and in operation, will reduce 50% of the predetermined pre-load $P_d$. Theoretically, the maximum load carried by the first nut member 20 could be as large as 100% of the predetermined pre-load $P_d$.

In operation of the hydro-forming press apparatus, the tie rod member 12 is subject to a tension stress variation due to the pre-load thereof and a pressure fluctuation within a die cavity of the hydro-forming press apparatus. Minimum and maximum loads at the threads engaged with the tensioner assembly 10 determine a fatigue strength of the tie rod member 12. More specifically, the effective parameters are the alternating stress range that is the difference of the maximum and minimum loads and a mean load that is the average of the maximum and minimum loads. The smaller the alternating load range and/or the mean load, the higher the fatigue strength.

In accordance with the present invention, the load carried by the first nut member 20 remains substantially constant during operation, while the second nut member 24 is subject to stress variation and may fail due to fatigue. The total load of the tie-rod 12 now is shared by two nut members 20 and 24, and the minimum and maximum stresses at threads engaged with the second nut member 24 are substantially reduced. In consequence, the alternating stress range and a mean stress are smaller, and the fatigue strength of the tie rod member 12 is improved.

Therefore, the present invention represents a novel arrangement of the tensioner assembly for compressing two or more objects using the rod member extending therethrough that greatly reduces the alternating stress range and the mean stress experienced by the rod member, thus considerably improving the fatigue strength of the rod member and reducing probability of fatigue failures.

The foregoing description of the preferred embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A tensioner assembly for detachably clamping at least two objects, said tensioner assembly comprising:

an elongated tie rod member;

a first nut member for removably engaging one of distal ends of said tie rod member, said first nut member having a plurality of threaded holes at spaced apart locations in said first nut member, said holes extending substantially parallel to said tie rod member;

a first set of jackbolts adapted to threadably engage said holes in said first nut member, said jackbolts being provided to extend from said holes to compressively bias said at least two objects;

a second nut member for removably engaging said one of said distal ends of said tie rod member, said second nut member positioned on said tie rod member between said thrust ring and said first nut member and axially spaced therefrom, said second nut member having a plurality of threaded holes at spaced apart locations in said second nut member, said holes extending substantially parallel to said rod member; and a second set of jackbolts adapted to threadably engage said holes in said second nut member, said jackbolts being provided to extend from said holes to compressively bias said at least two objects;

wherein said jackbolts are adapted to being torqued to a predetermined value to pre-load said tie rod member to a predetermined pre-load.

2. The tensioner assembly as defined in claim 1, said tensioner assembly further comprising a thrust member concentrically positioned on said tie rod member against one of said at least two objects, wherein said first set of jackbolts is provided to extend from said holes to compressively bias said thrust ring against one of said at least two objects, and said second set of jackbolts is provided to extend from said holes to compressively bias said thrust ring against one of said at least two objects.

3. The tensioner assembly as defined in claim 1, wherein said first nut member is primarily subjected to substantially constant pre-load and said second nut member is primarily subjected to substantially varying additional forces generated during operation of said at least two objects.

4. The tensioner assembly as defined in claim 1, wherein said thrust member has a pressure contact surface engaging said one of said at least two objects, a first support surface engaging said first set of said jackbolts and a second support surface engaging said second set of said jackbolts.

5. The tensioner assembly as defined in claim 1, wherein said first nut member has a centrally located threaded through bore for threadedly engaging a cooperating threaded portion of said one of said distal ends of said tie rod member, and said plurality of said threaded holes are spaced from and surrounding said through bore.

6. The tensioner assembly as defined in claim 5, wherein said first nut member has a substantially cylindrical peripheral side surface.

7. The tensioner assembly as defined in claim 5, wherein said first nut member has a substantially hexagonal peripheral side surface.

8. The tensioner assembly as defined in claim 1, wherein said second nut member has a centrally located threaded through bore for threadedly engaging a cooperating threaded portion of said one of said distal ends of said tie rod member, and said plurality of said threaded holes are spaced from and surrounding said through bore.

9. The tensioner assembly as defined in claim 8, wherein said second nut member has a substantially cylindrical peripheral side surface.

10. The tensioner assembly as defined in claim 1, wherein said thrust member has a cup-shaped body provided with a central through hole adapted to receive said tie rod member therethrough, a pressure contact surface in contact with one of said at least two objects, a first support surface facing said first nut member, and a second support surface facing said second nut member, said first support surface abuts said jackbolts provided in said first nut member and said second support surface abuts said jackbolts provided in said second nut member.

11. The tensioner assembly as defined in claim 1, wherein said tie rod member extends through said at least two objects.

12. The tensioner assembly as defined in claim 1, wherein said at least two objects are lower and upper platens of a hydro-forming press apparatus.

13. The tensioner assembly as defined in claim 12, wherein said hydro-forming press apparatus further includes at least one substantially cylindrical compression tube sandwiched between said lower and upper platens.

14. The tensioner assembly as defined in claim 13, wherein said tie rod member extends through said lower and upper platens and said at least one compression tube.

15. A hydro-forming press apparatus comprising:

a lower platen;

an upper platen;

at least one tie rod member extending through said lower and upper platens, said at least one tie rod member having a pair of opposite distal ends; and a tensioner assembly disposed on one of said opposite distal ends of said at least one tie rod member, said at least one tensioner assembly comprising:

a thrust member concentrically positioned on said tie rod member against said one of said upper platen and said lower platen;

a first nut member for removably engaging said one of said opposite distal ends of said at least one tie rod member, said first nut member having a plurality of threaded holes at spaced apart locations in said first nut member, said holes extending substantially parallel to said at least one tie rod member;

a first set of jackbolts adapted to threadably engage said holes in said first nut member, said jackbolts being provided to extend from said holes to compressively bias said thrust member against one of said upper platen and said lower platen;

a second nut member for removably engaging said one of said opposite distal ends of said at least one tie rod member; said second nut member positioned between said thrust ring and said first nut member and axially spaced therefrom, said second nut member having a plurality of threaded holes at spaced apart locations in said second nut member, said holes extending substantially parallel to said rod member; and a second set of jackbolts adapted to threadably engage said holes in said second nut member, said jackbolts being provided to extend from said holes to compressively bias said thrust ring against one of said upper platen and said lower platen;

wherein said jackbolts are adapted to being torqued to a predetermined value to pre-load said tie rod member to a predetermined pre-load.

16. The hydro-forming press apparatus as defined in claim 15, wherein said first nut member is primarily subjected to substantially constant pre-load and said second nut member is primarily subjected to substantially varying additional forces generated during operation of said hydro-forming press apparatus.

17. The hydro-forming press apparatus as defined in claim 15, wherein each of said first nut member and said second nut member has a centrally located threaded through bore for threadedly engaging a cooperating threaded portion of said one of said opposite distal ends of said at least one tie rod member, and said plurality of said threaded holes are spaced from and surrounding said through bore.

18. The hydro-forming press apparatus as defined in claim 15, wherein said thrust member has a cup-shaped body provided with a central through hole adapted to receive said at least one tie rod member therethrough, a pressure contact surface in contact with one of said upper platen and said lower platen, a first support surface facing said first nut member, and a second support surface facing said second nut member, said first support surface abuts said jackbolts provided in said first nut member and said second support surface abuts said jackbolts provided in said second nut member.

19. The hydro-forming press apparatus as defined in claim 15, wherein each of said first and second nut members has a substantially cylindrical peripheral side surface.

20. The hydro-forming press apparatus as defined in claim 15, further comprising a second tensioner assembly disposed on the other of said distal ends of said at least one tie rod member opposite to and substantially identical to said tensioner assembly.

* * * * *